US006504510B2

(12) United States Patent
Kim

(10) Patent No.: US 6,504,510 B2
(45) Date of Patent: Jan. 7, 2003

(54) ANTENNA SYSTEM FOR USE IN A WIRELESS COMMUNICATION SYSTEM

(75) Inventor: Duk-Yong Kim, Kyungki-do (KR)

(73) Assignee: KMW Inc., Kyungki-do (KR)

( * ) Notice: Subject to any disclaimer, the term of this patent is extended or adjusted under 35 U.S.C. 154(b) by 0 days.

(21) Appl. No.: 09/826,849

(22) Filed: Apr. 6, 2001

(65) Prior Publication Data

US 2002/0053995 A1 May 9, 2002

(30) Foreign Application Priority Data

Nov. 3, 2000 (KR) ..... 2000-65211

(51) Int. Cl.[7] ..... H01Q 3/22
(52) U.S. Cl. ..... 343/702; 342/368
(58) Field of Search ..... 342/372, 368, 342/376; 343/702, 776, 778, 853, 763, 371, 373; 333/101, 105, 125

(56) References Cited

U.S. PATENT DOCUMENTS 5,872,491 A 2/1999 Kim et al. ..... 333/101
5,905,462 A * 5/1999 Hampel et al. ..... 342/372
5,952,964 A * 9/1999 Chan ..... 342/368
6,037,910 A * 3/2000 Solbach et al. ..... 343/776
6,252,548 B1 * 6/2001 Jeon ..... 342/383

* cited by examiner

*Primary Examiner*—Don Wong
*Assistant Examiner*—James Clinger
(74) *Attorney, Agent, or Firm*—Greenblum & Bernstein, P.L.C.

(57) ABSTRACT

An antenna system for use in a wireless communication system includes an array of M×N radiating elements for emitting a beam, an input port for providing signals to the array of M×N radiating elements, M number of first phase shifters for steering the beam on the basis of column by phase shifting the signals from the input port, N number of second phase shifters for steering the beam on the basis of row by phase shifting the signals, N number of switchable dividers for selectively transmitting the signals to a number of transmission lines incorporated into the second phase shifters and M number of combiner/dividers for transmitting the signals from the transmission lines of the second phase shifters to the transmission lines of the first phase shifters. The antenna system can implement a 3-way beam control by utilizing multi-line phase shifters and switchable dividers. Therefore, the antenna system controls cell coverage more flexible than any other prior arts and become friendly with user and the communication environment by utilizing the 3-way beam control. Further, the antenna system can enhance performance and reduce cost by using the multi-line phase shifters.

31 Claims, 12 Drawing Sheets

ANTENNA SYSTEM FOR USE IN A WIRELESS COMMUNICATION SYSTEM

FIELD OF THE INVENTION

The present invention relates to an antenna system for use in a wireless communication system; and, more particularly, to an antenna system incorporated therein an array of phase shifters for steering beams in three-dimensional.

DESCRIPTION OF THE PRIOR ART

As is well known, it is sometimes desirable to adjust the orientation of a radiation beam emitted from a broadcast antenna. In particular, if a broadcast antenna is installed at a higher altitude than other antennas that communicate with the broadcast antenna, it must be tilted downward to steering a radiation beam emitted therefrom. This down tilting of the radiation beam alters a coverage angle and may reduce interference with nearby broadcast antennas, and may enhance communications with mobile users situated in valleys below the broadcast antenna.

Referring to FIG. 1, there is shown a conventional antenna system 10, which is capable of mechanically down-tilting a beam 16 radiated from an antenna 12 incorporated into the antenna system 10. The antenna 12 is mounted atop a mast 14 at a height above ground which is in many cases about 200 feet.

In case when the orientation of a radiation beam is adjusted downward, the entire antenna 12 must be mechanically down tilted. One of the major shortcomings is that this approach is generally regarded as too rigid and too expensive. There is the approach that electrically down tilting the radiation beam by adjusting the relative phases of the radiation associated with each of several radiators of an antenna.

Referring to FIG. 2, there is shown a schematic diagram illustrating a conventional antenna system 20, which is capable of electrically down-tilting a beam 26 radiated from an antenna array 22 incorporated into the antenna system 20. In the system, the antenna array 22 incorporates therein an array of radiators and a single point signal feed network provided with a scan network to couple the single point network to the array 22 of radiators. The scan network includes a plurality of transmission lines between the feed network and each radiator. Among these electrical down tilting methods is a capacitive coupling method, in which an adjustable capacitance is placed in series with the transmission lines to provide a plurality of signals to each radiator of the antenna array 22, thus causing the desired phase shifts. A phase shifter is associated with each radiator of the antenna array 22 such that the phase shifted beam from each radiator constructively interferes with the beam 26 from every other radiator to produce a composite beam radiating at an angle from a line normal to the surface of the antenna. By changing the phase shift provided by each phase shifter, the beam can be scanned across the antenna surface. Another such approach is to use different lengths of transmission lines for feeding the different elements to produce a permanent electrical down tilting.

There are a number of problems associated with the above-described antenna systems 10, 20, however. First of all, both of the antenna systems 10, 20 cannot steer a radiation beam in horizontal direction.

Another problem of the prior art is that it requires a number of phase shifters corresponding to the number of the transmission lines in the prior art antenna systems 10, 20.

In addition, in the prior art antenna systems 10, 20, it requires a mechanically complex, for example using a rack and pinion assembly or a number of phase shifters corresponding to the number of radiators, for providing the desired phase shift.

Further, the prior art antenna systems 10, 20 cannot modulate a width of beam in horizontal and in vertical.

Finally, a beam is scanned in vertical and in horizontal by utilizing the prior art antenna systems, it has too much scan loss.

SUMMARY OF THE INVENTION

It is, therefore, an object of the present invention to provide an antenna array capable of electrically elevating a beam emitted therefrom by utilizing a multi-line phase shifter.

It is another abject of the present invention to provide an antenna system for electrically steering a beam emitted therefrom in horizontal by using a multi-line phase shifter.

It is another object of the present invention to provide an antenna system capable of electrically steering a beam radiated therefrom in both vertical and Azimuth direction.

It is another object of the present invention to provide an antenna system for selectively switching a beam width in horizontal by using a switchable divider.

It is another object of the present invention to provide an antenna system for controlling a beam radiated therefrom in a 3-way.

It is another object of the present invention to provide an antenna system for minimizing interference and maximizing cell capacity.

It is another object of the present invention to provide an antenna system for providing an optimal cell planning and meeting the real world of diverse environments.

It is another object of the present invention to provide an antenna system capable of harmonizing with communication environment.

It is another object of the present invention to provide an antenna system with a stable and stable installation.

In accordance with one aspect of the present invention, there is provided an antenna system for use in a wireless communication system, comprising: an array of M×N radiating elements for emitting a beam, M and N being a positive integer, respectively; an input port for providing signals to the array of M×N radiating elements; M number of first phase shifters for steering the beam on the basis of column by phase shifting the signals from the input port; N number of second phase shifters for steering the beam on the basis of row by phase shifting the signals; N number of switchable dividers for selectively transmitting the signals to a number of transmission lines incorporated into the second phase shifters; M number of combiner/dividers for transmitting the signals from the transmission lines of the second phase shifters to the transmission lines of the first phase shifters; a horizontal motor driver for control the first phase shifters; a vertical motor driver for control the second phase shifters; and a beam control board for control the horizontal motor driver, a vertical motor driver and the switchable dividers.

In accordance with another aspect of the present invention, there is provided an antenna system for use in a wireless communication system, comprising: an array of N radiating elements for emitting a beam, N being a positive integer; a feeding network for providing a plurality of signals to the array of N radiating elements; and a phase shifter for steering the beam by simultaneously phase shifting the signals from the feeding network.

In accordance with another aspect of the present invention, there is provided an antenna system for use in a wireless communication system, comprising: an array of N radiating elements for emitting a beam, N being a positive integer; a switchable divider for selectively providing a signal to the array of N radiating elements; and a phase shifter for steering the beam by simultaneously phase shifting the signals from the feeding network.

BRIEF DESCRIPTION OF THE DRAWINGS

The above and other objects and features of the present invention will become apparent from the following description of the preferred embodiments given in conjunction with the accompanying drawings, in which.

DETAILED DESCRIPTION OF THE PREFERRED EMBODIMENTS

There are illustrated in FIGS. 3 to 12 various views of an antenna system 100 for use in a wireless communication in accordance with preferred embodiments of the present invention.

Figure 1:
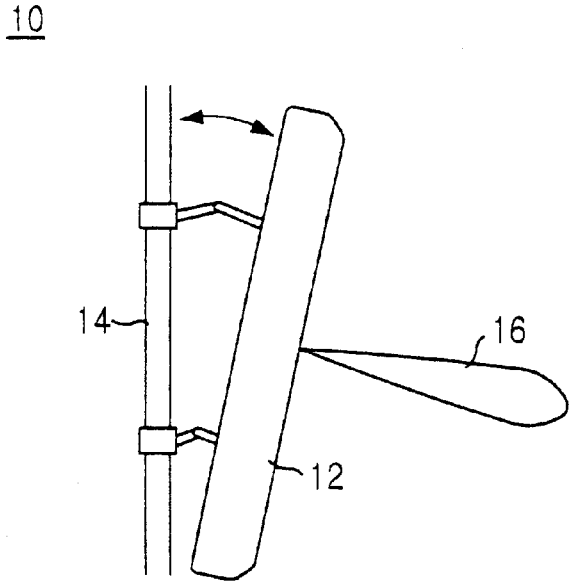
FIG. 1 (PRIOR ART)
FIG. 1 shows a schematic diagram representing a conventional antenna system, which is capable of mechanically down-tilting a beam radiated from the antenna system in vertical direction.
Figure 2:
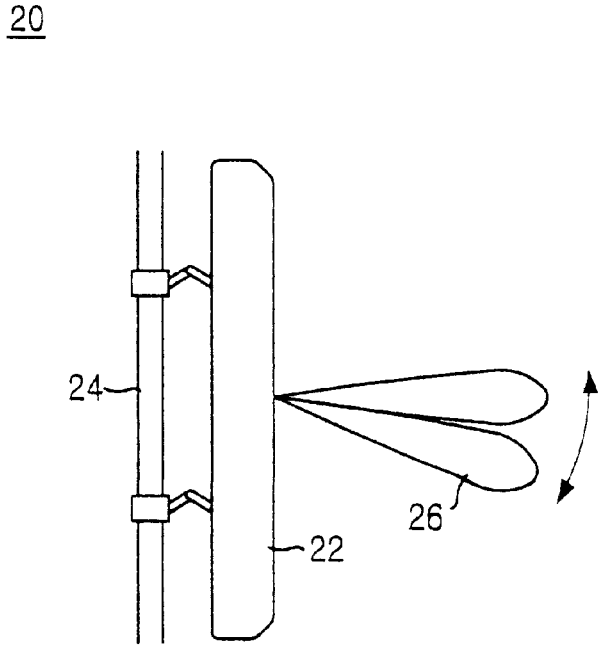
FIG. 2 (PRIOR ART)
FIG. 2 depicts a schematic diagram illustrating a conventional antenna system, which is capable of electrically down-tilting a beam radiated from the antenna system in vertical direction.
Figure 3:
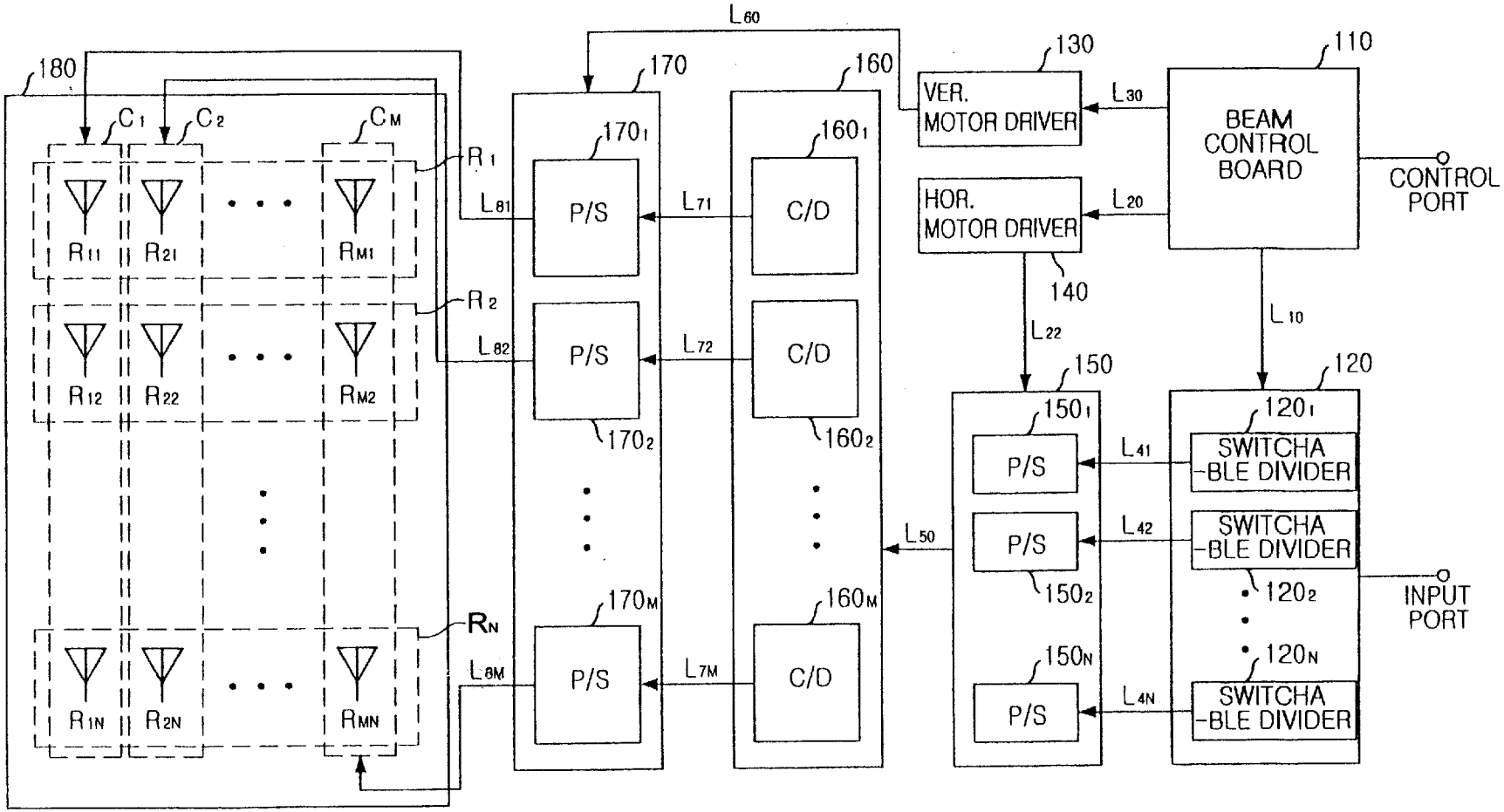
FIG. 3 is a block diagram showing an antenna array in accordance with the present invention.

In FIG. 3, there is provided a block diagram of an antenna system 100 for use in a wireless communication system. The antenna system comprises a beam control board 110, a switchable divider block 120, a first phase shifter (P/S) block 150, a combiner/divider (C/D) block 160, a second P/S block 170 and an array 180 of M×N radiators, wherein M and N are positive integers, respectively. The array 180 includes M number columns $C_1$ to $C_M$ and N number of rows $R_1$ to $R_N$, each of the columns $C_1$ to $C_M$ including N number of radiators. For example, N numbers of radiators in the first column $C_1$ represent $R_{11}$ to $R_{1N}$, respectively. The radiators in each column are vertically oriented and the columns $C_1$ to $C_M$ are positioned parallel with each other. The antenna system 100 further comprises a vertical motor driver 130 and a horizontal motor driver 140. The switchable divider block 120 includes N number of switchable dividers $\mathbf{120}_1$ to $\mathbf{120}_N$ and the C/D block 160 includes M number of C/Ds $\mathbf{160}_1$ to $\mathbf{160}_N$. And, The first P/S block 150 includes N number of first P/Ss $\mathbf{150}_1$ to $\mathbf{150}_N$ and the second P/S block 170 includes M number of second P/Ss $\mathbf{170}_1$ to $\mathbf{170}_M$.

In the system 100, a control signal is inputted to the beam control board 110 through a control port installed therein. The beam control board generates a first, a second and a third control signals, wherein the first control signal is used for horizontal beam width switching (HBWSw), the second control signal is used for horizontal beam steering (HBSt) and the third control signal is used for vertical beam down tilting (VBDT).

Meanwhile, N number of signals is inputted to the switchable dividers $\mathbf{120}_1$ to $\mathbf{120}_N$ through an input port. Each of the switchable dividers $\mathbf{120}_1$ to $\mathbf{120}_N$ is capable of varying its operating mode.

Figure 4:
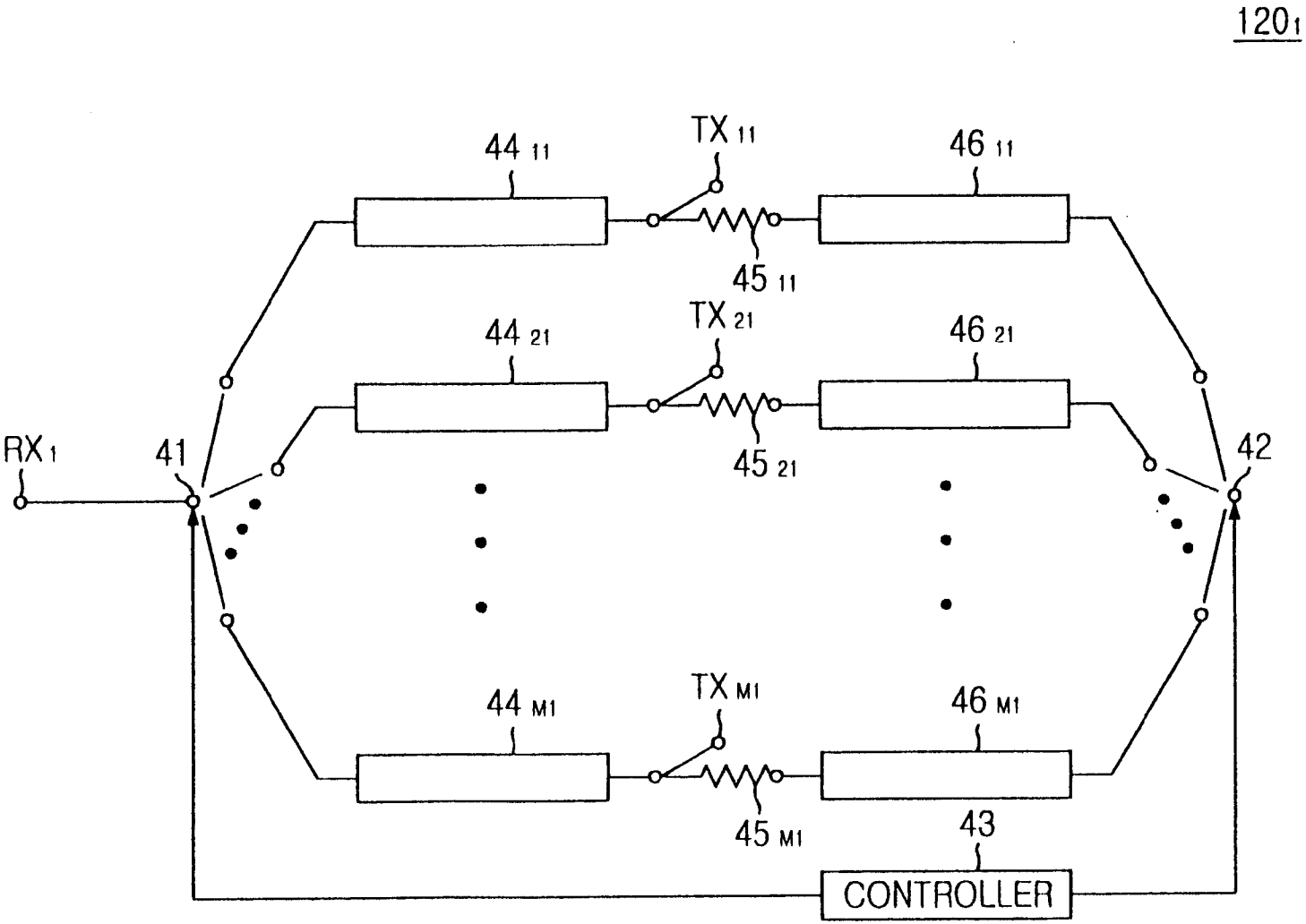
FIG. 4 describes a detailed diagram depicting one of the switchable divider shown in FIG. 3.

Referring to FIG. 4, there is a schematic representation of a switchable divider 120, for use in the present invention. The switchable divider 120, includes an input port $RX_1$ for receiving an RF signal from the input port, first transmission lines $\mathbf{44}_{11}$–$\mathbf{44}_{M1}$, second transmission lines $\mathbf{46}_{11}$–$\mathbf{46}_{M1}$, isolation resistors $\mathbf{45}_{11}$–$\mathbf{45}_{M1}$, output ports $TX_{11-TXM1}$, a first switch 41 and a second switch 42. The switchable divider $\mathbf{120}_1$ is described in an M-way operating mode. In the preferred embodiment, the switchable divider 120, operates as a divider to equally divide the RF signal into M number of output signals at a maximum operating mode. The switchable divider $\mathbf{120}_1$ can vary its operating mode based on the first control signal from the beam control board 110 via line $L_{10}$. The switchable divider $\mathbf{120}_1$ is described in detail in commonly owned U.S. Pat. No. 5,872,491 issued Feb. 16, 1999, which is incorporated herein by reference.

Figure 10A:
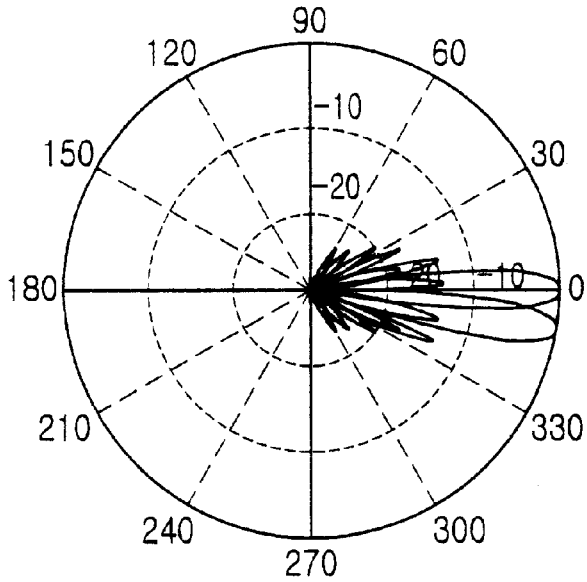
FIG. 10A plots a beam pattern for electrically down tilting a beam emitted from the antenna system shown in FIG. 3.
Figure 10B:
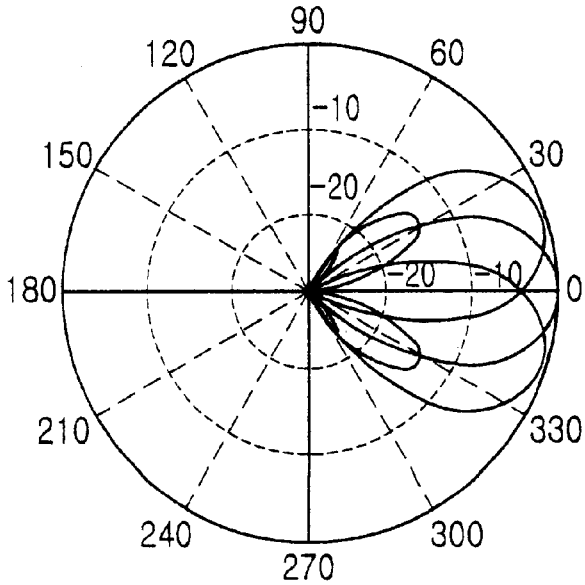
FIG. 10B plots a beam pattern for horizontally steering a beam emitted from the antenna system shown in FIG. 3.
Figure 10C:
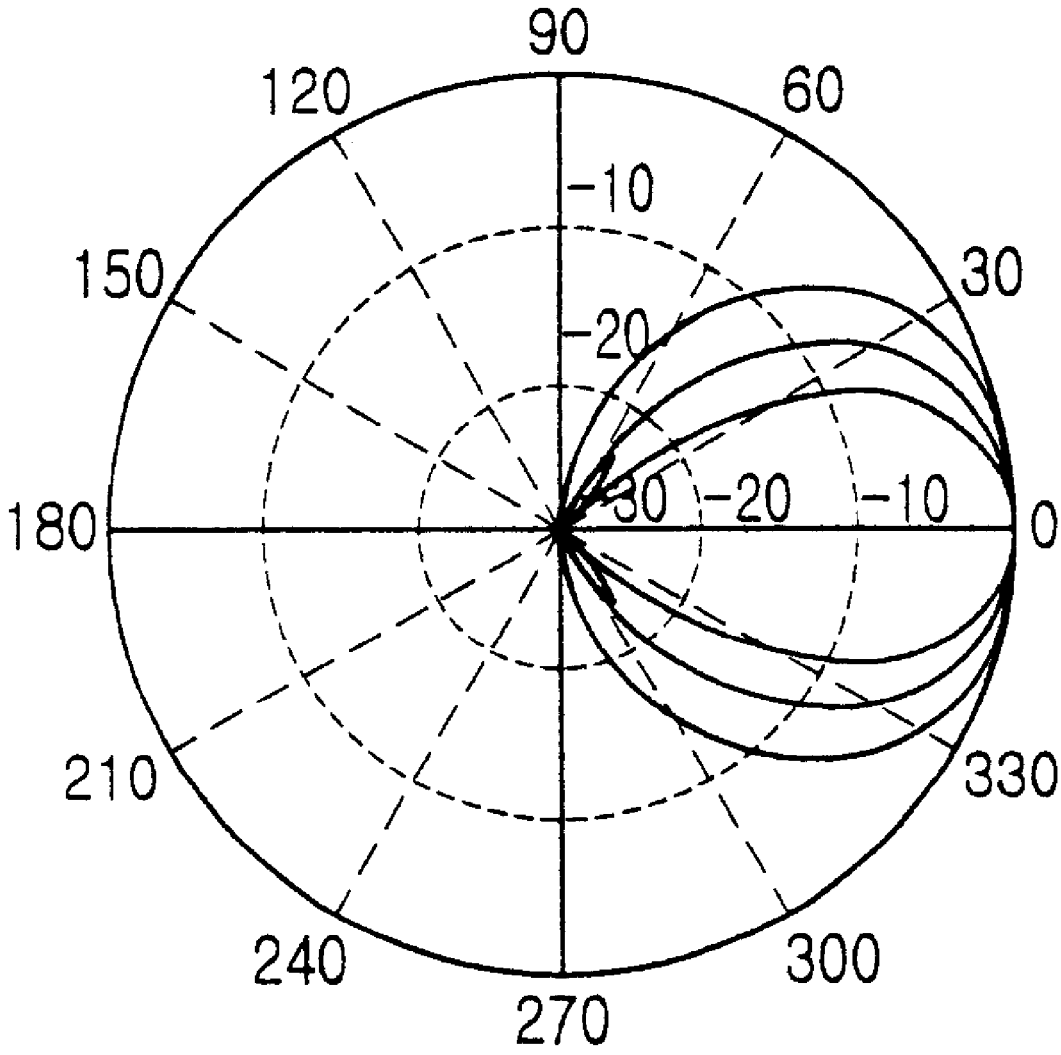
FIG. 10C plots a beam pattern for horizontally switching a width of a beam emitted from the antenna system shown in FIG. 3.

Referring back to FIG. 3, each of the switchable dividers $\mathbf{120}_1$ to $\mathbf{120}_N$ provides a plurality of divided signals to the first P/Ss $\mathbf{150}_1$ to $\mathbf{150}_N$ through lines $L_{41}$ to $L_{4N}$, respectively. In each of the switchable dividers $\mathbf{120}_1$ to $\mathbf{120}_N$, the number of divided signals is equal to that of the operating modes. In the preferred embodiment, the antenna system 100 can modulate a width of beam emitting from its antenna array 180 by changing the number of operating modes. The simulation data are shown in FIGS. 10A to 10C.

On the other hand, the horizontal motor driver 140 generates N number of motor control signals in response to the second control signal from the beam control board 110 through line $L_{20}$. Each motor control signal is inputted to a corresponding first P/S via line $L_{22}$ and used for rotating a dielectric member incorporated into the corresponding first P/S.

Figure 5:
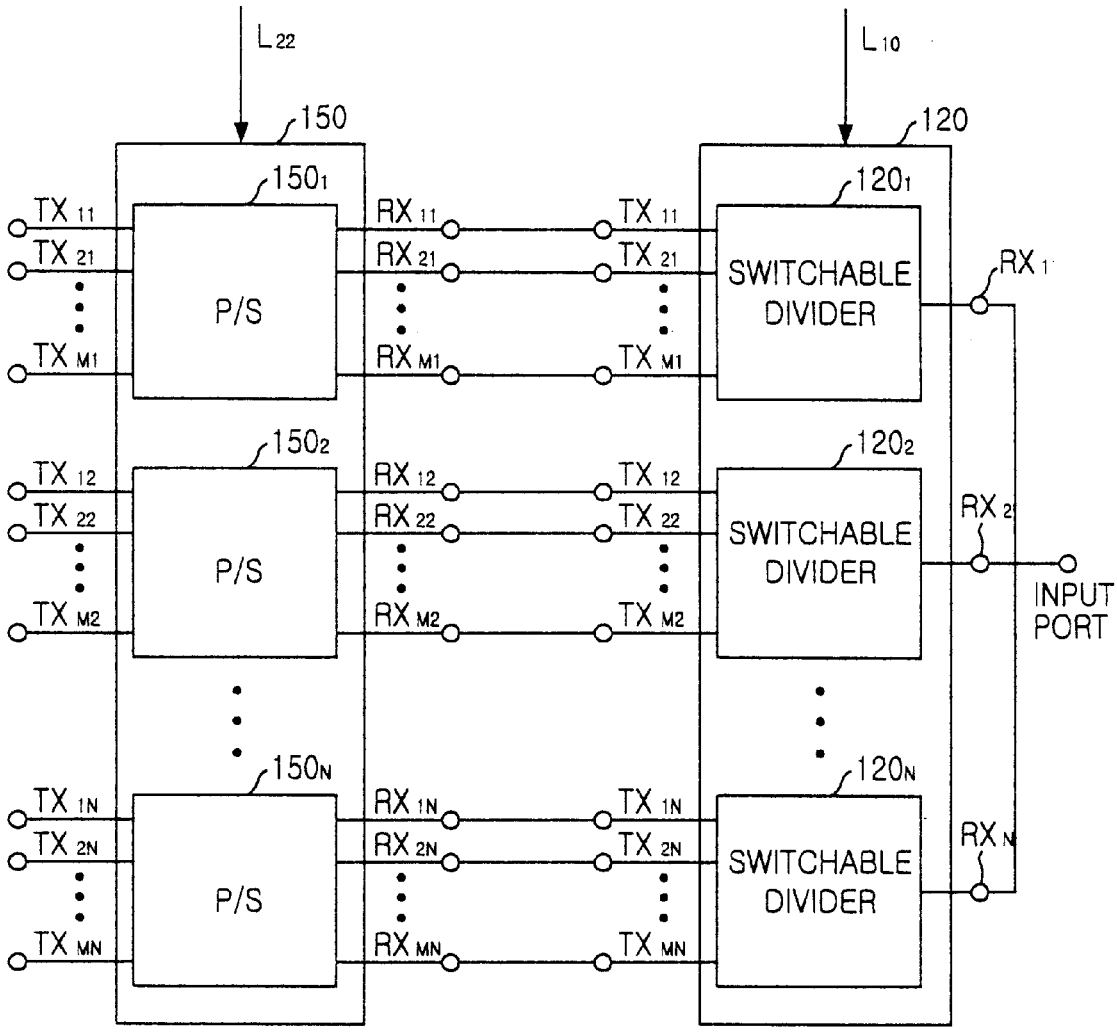
FIG. 5 shows a detailed view showing a relationship between a switchable divider block and a first phase shifter block of FIG. 3.
Figure 6:
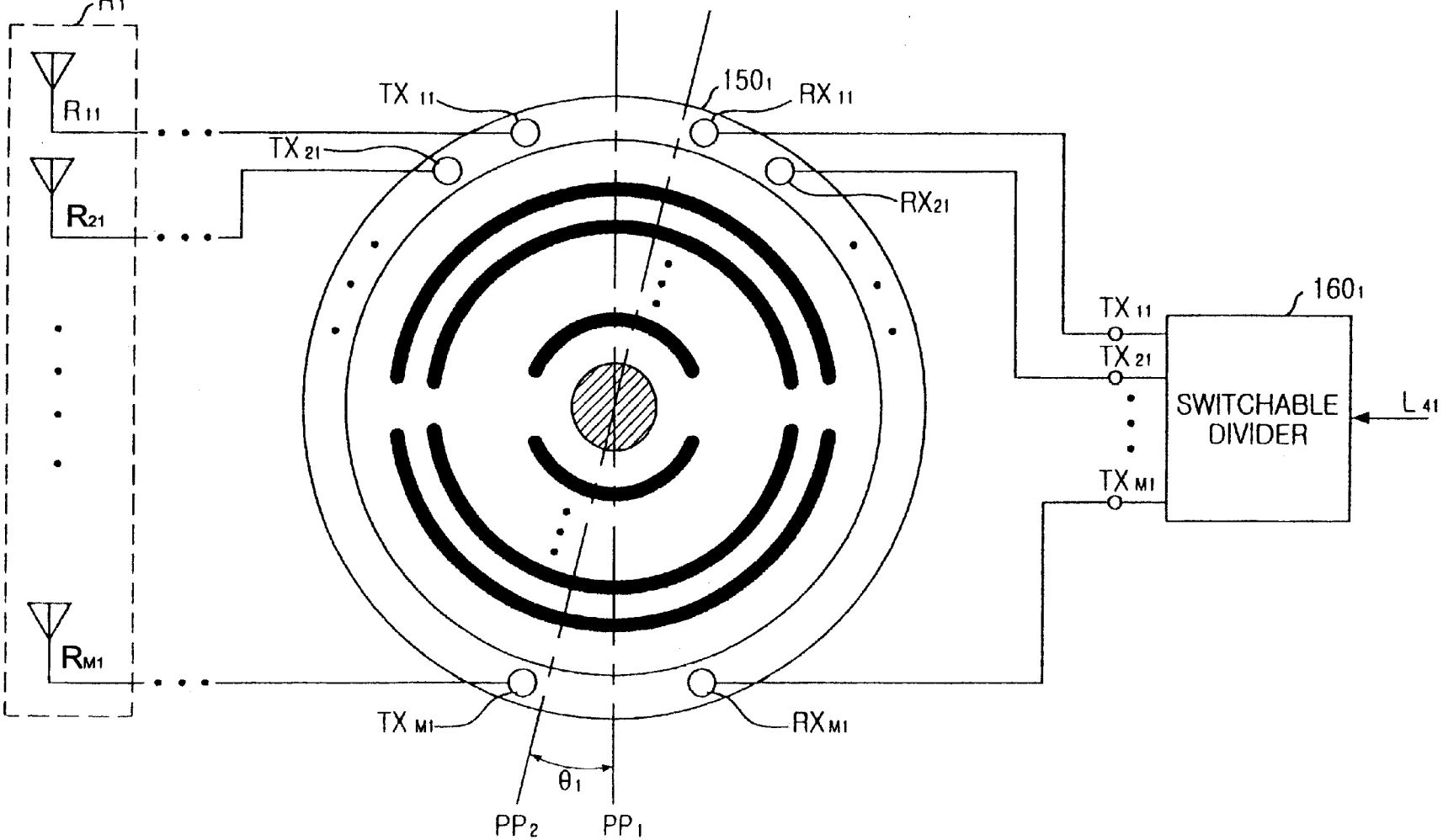
FIG. 6 represents a detailed view depicting a relationship between a first phase shifter and its neighbor elements.
Figure 7:
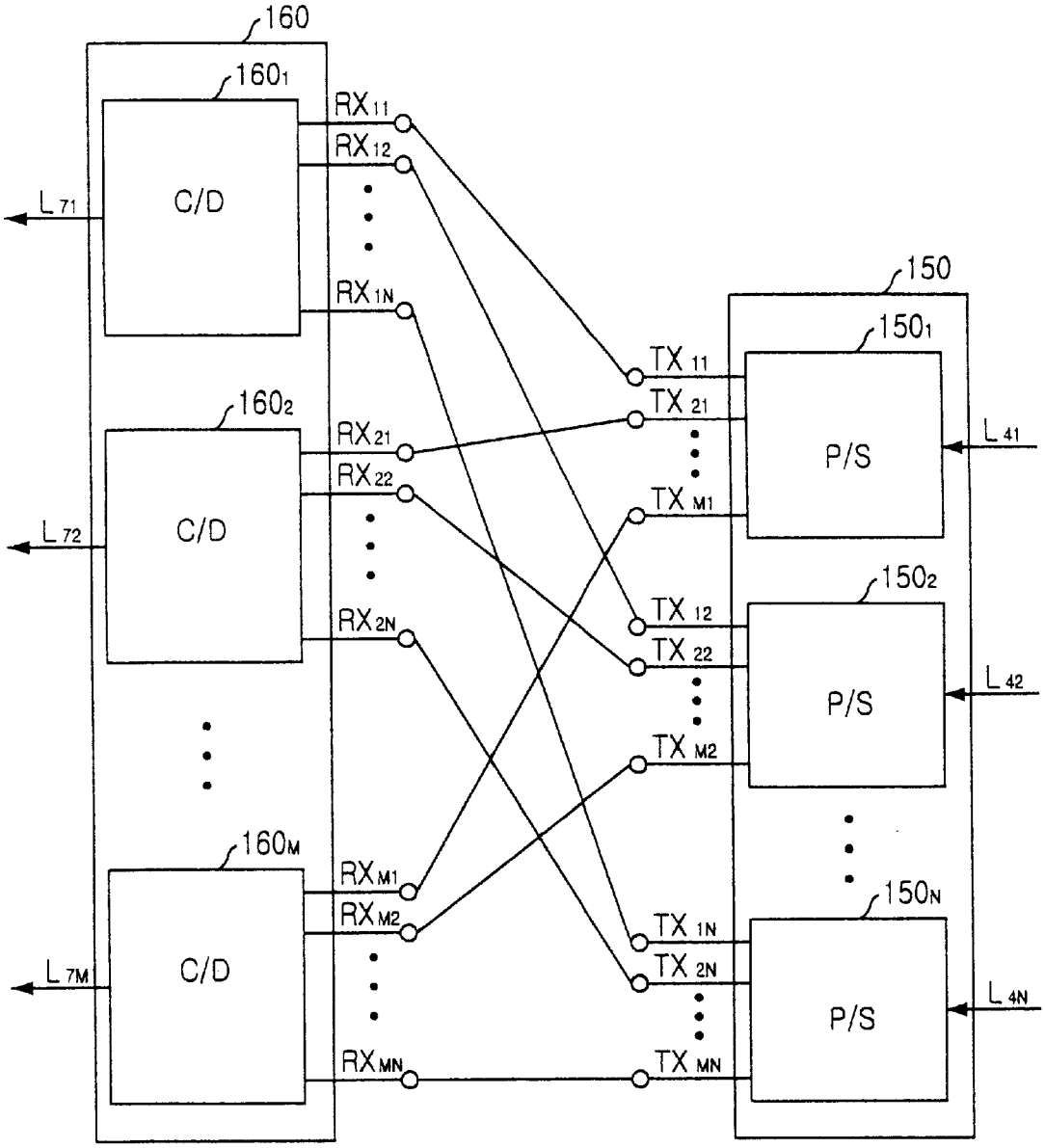
FIG. 7 illustrates a detailed view showing a relationship between a combiner/divider block and a first phase shifter block of FIG. 3.

Referring to FIGS. 5 and 6, each of the divided signals from the output ports $TX_{11}$ to $TX_{MN}$ of the switchable divider block 120 is inputted to a corresponding input port of the first P/S block 150. For example, the divided signals from $TX_{11}$ to $TX_{M1}$ are inputted to $RX_{11}$ to $RX_{M1}$ of the first phase shifter $\mathbf{150}_3$.

Referring to FIG. 6, there is shown a detailed diagram representing a relationship between the first phase shifter $\mathbf{150}_1$ and neighbor elements shown in FIG. 3. The first phase shifter $\mathbf{150}_1$ includes a dielectric member (not shown), M number of transmission lines, M number of input ports $RX_{11}$ to $RX_{M1}$ and M number of output ports $TX_{11}$ to $TX_{M1}$. As shown in this figure, it is possible to simultaneously modulate phases of the divided signals from the switchable divider $\mathbf{120}_1$ by rotating the dielectric member at a predetermined angle $\theta_1$. The electrical lengths of the transmission lines located at a half portion increase to a predetermined degree, and those of the other portion decrease to the predetermined degree, simultaneously. The first P/S $\mathbf{150}_1$ is described in detail in commonly owned U.S. patent application Ser. No. 09/798,908 to KIM et al., filed on Mar. 6, 2001 and entitled "SIGNAL PROCESS APPARATUS FOR PHASE-SHIFTING N NUMBER OF SIGNALS INPUTTED THERETO", which is incorporated herein by reference.

In the preferred embodiment, each of the first P/Ss $\mathbf{150}_1$ to 150 can implement a horizontal beam steering. For example, if the horizontal motor driver 140 send a motor control signal to the first P/S $\mathbf{160}_1$ to rotate the dielectric member at the predetermined angle $\theta_1$. Half of divided signals from the switchable divider $\mathbf{120}_1$ are phase-shifted in advance and the other are phase-delayed after passing through the first P/S $\mathbf{150}_1$. Therefore, in the row $R_1$ of the antenna array 180, each of the radiators $R_{11}$ to $R_{M1}$ receives a different signal, which is linearly symmetric with respect to a center point of the row $R_1$. That is, the antenna can electrically steering a beam emitted from the row $R_1$ in horizontal based on the rotation of the dielectric member.

The phase-shifted signals are transmitted to the C/D block 160 through line $L_{50}$. The detailed description is described with reference to FIG. 7. The first phase shifter $\mathbf{150}_1$, $\mathbf{150}_2$ and $\mathbf{150}_N$ include output ports $TX_1$ to $TX_{M1}$, $TX_{21}$ to $TX_{2M}$ and $TX_{1N}$ to $TX_{MN}$, respectively. And also, the CDs $\mathbf{160}_1$, $\mathbf{160}_2$ and $\mathbf{160}_M$ include input ports $RX_{11}$ to $RX_{1N}$, $RX_{21}$ to $RX_{2N}$ and $RX_{M1}$ to $RX_{MN}$, respectively. Each of the phase-shifted signals from the output ports $TX_{11}$ to $TX_{MN}$ is transmitted to a corresponding input port. For example, if a phase-shifted signal from the output port $TX_{21}$ of the first phase shifter block 150 is transmitted to the input port $RX_{21}$ of the C/D block 160. That is, an output port $TX_{MN}$ is connected to a input port $RX_{MN}$ in such a way that the sub-index of the output port $TX_{MN}$ corresponds to that of the input port $RX_{MN}$.

Each of the C/Ds $\mathbf{160}_1$ to $\mathbf{160}_M$ transmits the phase-shifted signals from the first P/Ss $\mathbf{150}_1$–$\mathbf{150}_M$ to the corresponding second phase shifter through lines $L_{71}$ to $L_{7M}$, as shown in FIG. 3. Each of the second phase shifter $\mathbf{170}_{1-170M}$ transmits the signals from the C/D block 160.

Figure 8:
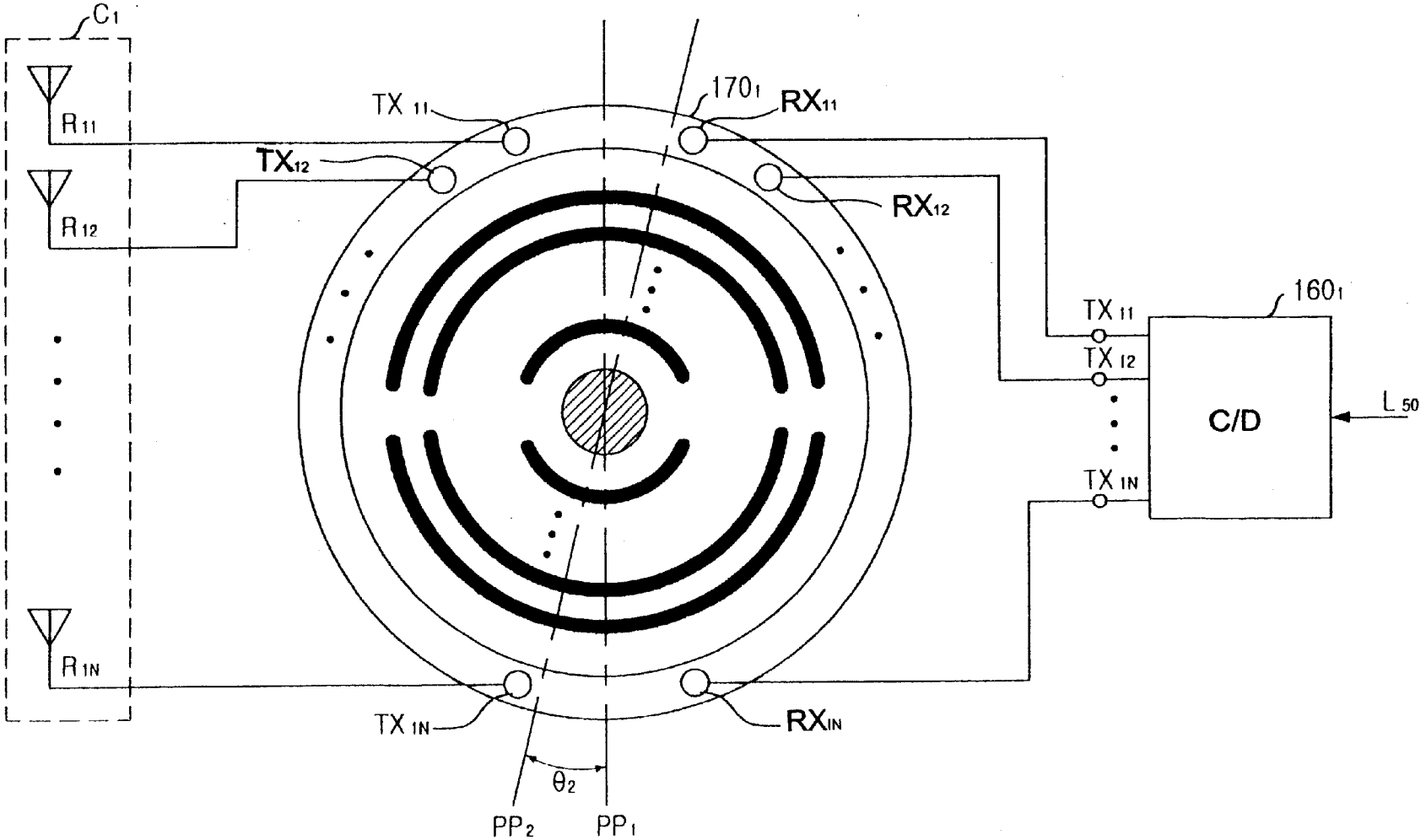
FIG. 8 presents a detailed view illustrating a relationship between a first phase shifter block and its neighbor elements of FIG. 3.

Referring to FIG. 8, there is shown a detailed diagram representing a relationship between the second phase shifter $\mathbf{170}_1$ and neighbor element shown in FIG. 3. The function and the structure of the second P/S $\mathbf{170}_1$ is similar to those of the first P/S $\mathbf{150}_1$ except that the second P/S $\mathbf{170}_1$ has N number of transmission lines. And also, it is possible to simultaneously modulate phases of signals inputted to the input ports $RX_{11}$ to $RX_{1N}$ by rotating the dielectric member at a predetermined angle $\theta_2$. The electrical lengths of the transmission lines located at a half portion increase to a predetermined degree, those of the other portion decrease to the predetermined degree, simultaneously.

Down tilting is used to decrease a cell size from a beam shape directed to the horizon to the periphery of the cell. This provides a reduction in beam coverage, yet allows a greater number of users to operate within a cell since there is a reduction in the number of interfering signals. In the preferred embodiment, this down tilting can be obtained by rotating the dielectric members incorporated into the second P/S $\mathbf{170}_1$ to $\mathbf{170}_M$ for each column $C_1$ to $C_M$. Specifically, in accordance with the preferred embodiment of the present invention, the signals inputted through half of the input ports $RX_{11}$ to $RX_{1(N-1)/2}$ are shifted in advance and the signals inputted through the input ports $RX_{1N/2}$ to $RX_{1N}$ are delayed in phase after passing through the output ports $TX_{11}$ to $TX_{1N}$. The amount of shifted phase has a linear symmetry with respect to the center points of each column $C_1$–$C_M$ due to a symmetric arrangement of the second phase shifter.

Figure 9:
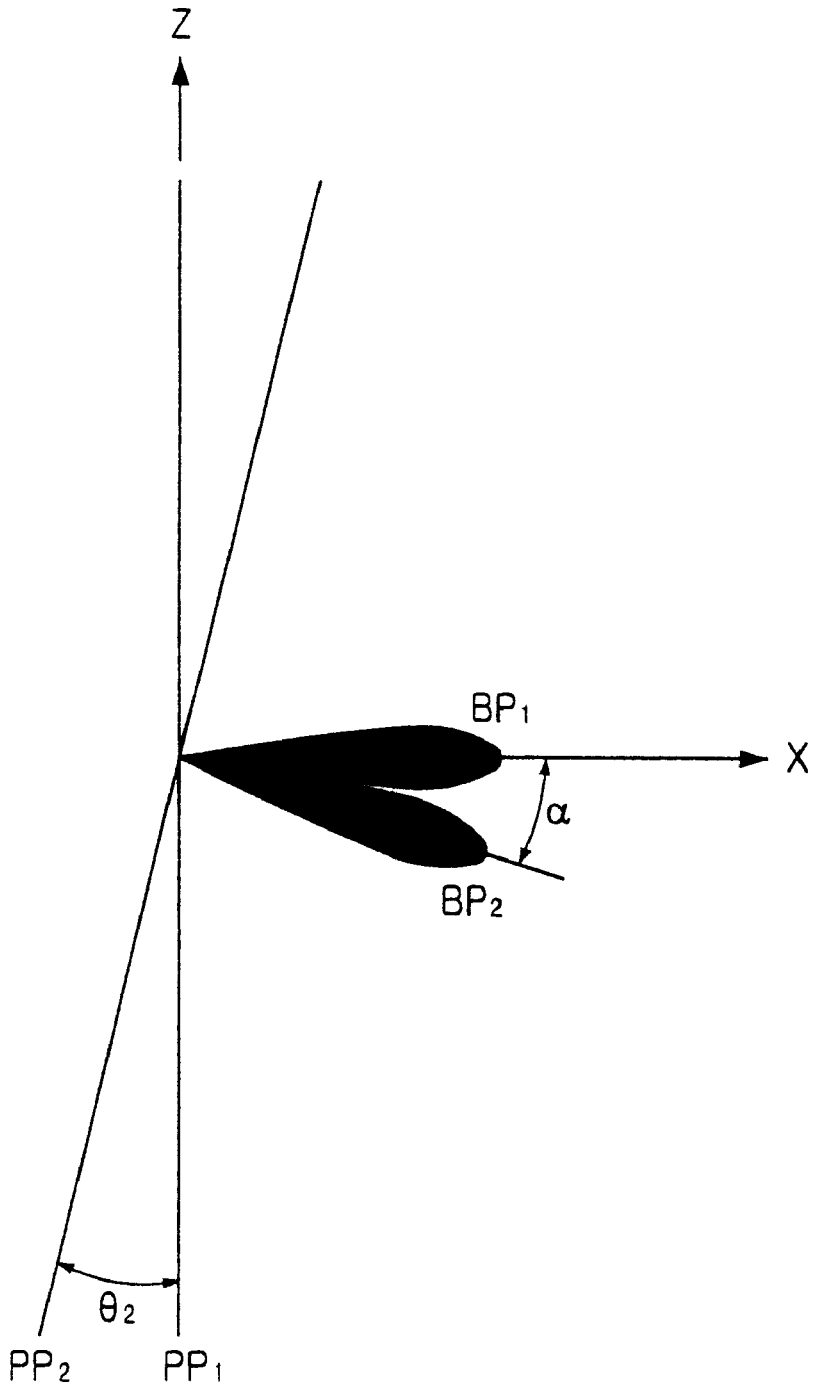
FIG. 9 is a schematic representation of a beam from the antenna system carried out a down-tilt in accordance with the present invention.

Referring to FIG. 9, there is shown a schematic representation of a beam radiated from the antenna system with carrying out a down-tilt in accordance with the present invention. If the second P/S does not rotates the dielectric member, the signals outputted from the output ports $TX_{11}$ to $TX_{1N}$ are located at a phase plane $PP_1$. In this case, the beam radiated from the array 180 of the radiators $R_{11}$ to $R_{MN}$ has a beam pattern $BP_1$. Whereas, if the second P/S rotates the dielectric member to the predetermined angle $\theta_2$, the signals outputted from the output ports $TX_{11}$ to $TX_{1N}$ are located at a phase plane $PP_2$. Therefore, the beam radiated from the array 180 of the radiators $R_{11}$ to $R_{MN}$ has a beam pattern $BP_2$ which is rotated degrees from the beam pattern $BP_1$.

Referring to FIG. 10A, there are shown antenna gain plots on polar coordinate in the horizontal plane at the level of the antenna when the antenna system 100 of FIG. 3 implements the down tilting with rotating the dielectric members of the second P/Ss $\mathbf{170}_1$ to $\mathbf{170}_M$.

FIG. 10B shows antenna gain plots on polar coordinate in the horizontal plane when the antenna system of FIG. 3 implements the horizontal beam steering with rotating the dielectric members of the first P/Ss $\mathbf{150}_1$ to $\mathbf{15O}_N$.

FIG. 10C plots an antenna gain when the antenna system of FIG. 3 implements the horizontally beam width switching. In this case, the array 180 is made of radiators $R_{11}$ to $R_{48}$ for applying IMT-2000. That is the number of columns is 4 and the number of rows is 8. The first phase shifter block 150 has only one first phase shifter in order to control all of the rows in the same manner. Therefore, the switchable divider block 120 has one switchable divider. The switchable divider is set to operate at 4-way at a maximum operating mode. As can be shown, when the switchable divider operates at 4-way, the beam radiated from the array 180 has a HPBW (half power beam width) to be approximately 32 degrees. If the switchable divider operates at 3-way, the beam has HPBW to be approximately 45 degrees. And, the switchable divider operates at 2-way, the beam has HPBW to be approximately 64 degrees.

Figure 11:
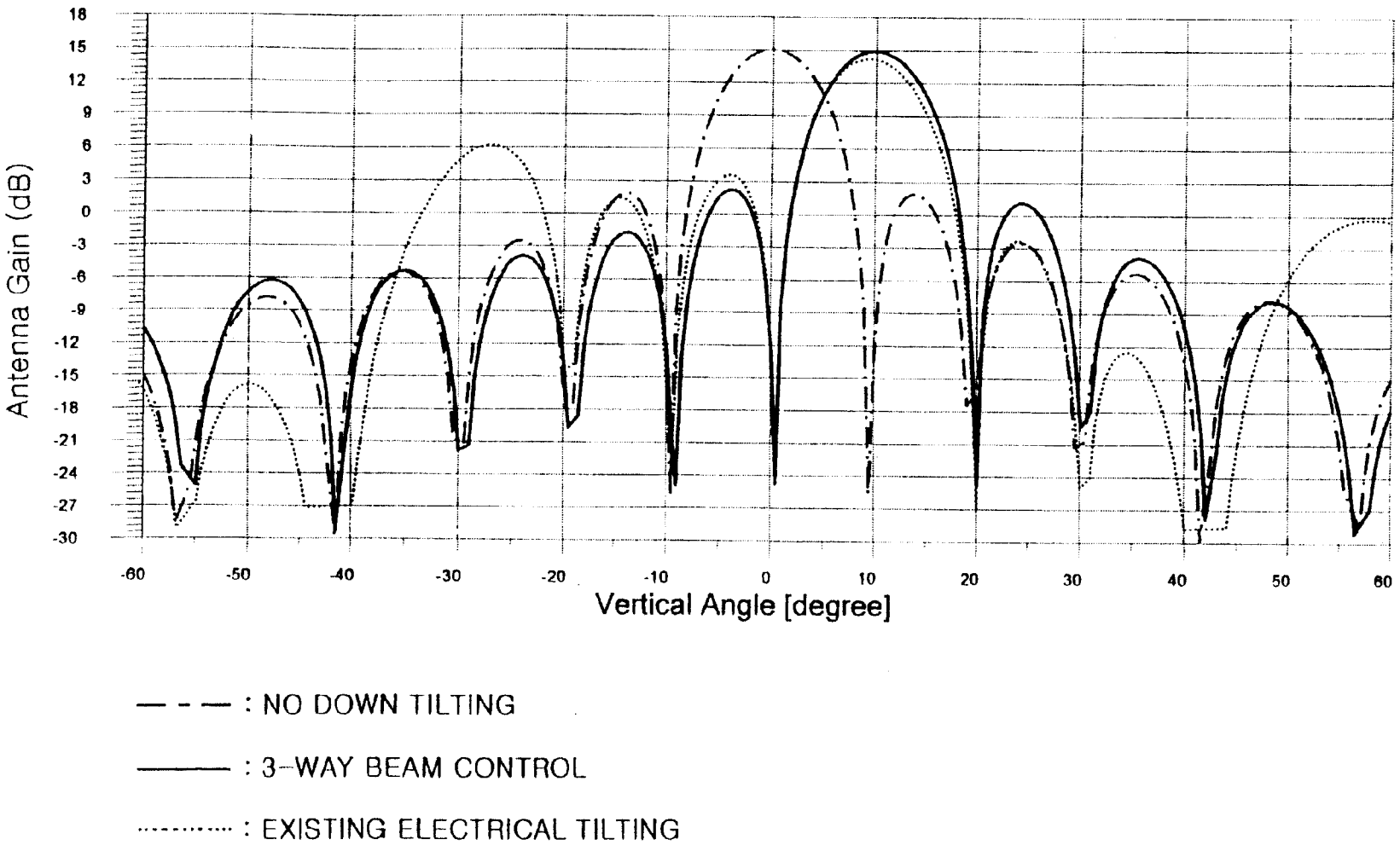
FIG. 11 represents a graph showing a comparison data between the present invention and a conventional antenna system based on PCS band due to no existing electrical tilting antenna for IMT-2000.

FIG. 11 represents a graph showing a comparison data between the present invention and a conventional antenna system based on PCS band due to no existing electrical tilting antenna for IMT-2000. A solid line, a dot line and one dot-dash line represent a no down tilting, a 3-way beam control and an existing electrical down tilting, respectively. When the prior art antenna is electrically down tilted, it has a scan loss with 0.9 dB and a side lobe level with 7.6 dB. Whereas, the antenna system 100 implements a 3-way beam control in accordance with the present invention, the beam radiated from the array 180 has a scan loss with 0.2 dB and a side lobe level with 12.7 dB. Therefore, the present invention can increase call quality and reducing interference.

Figure 12:
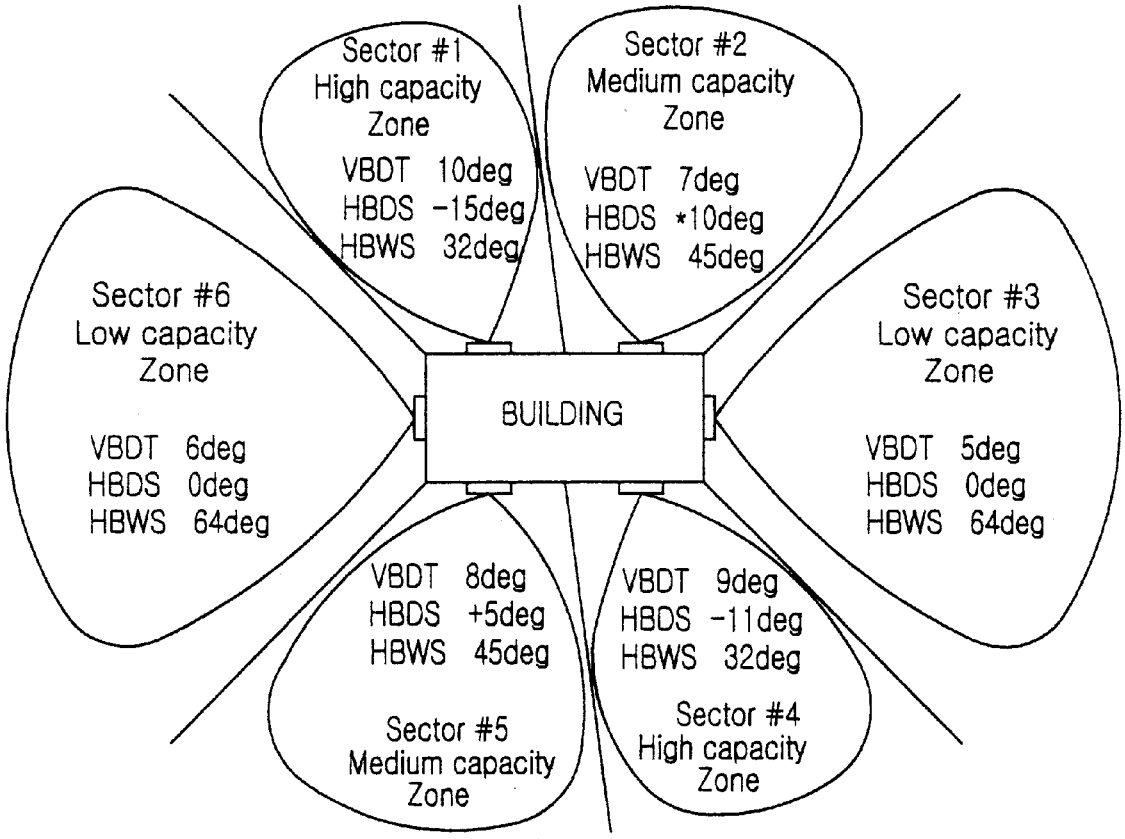
FIG. 12 is a diagram illustrating an exemplary application of the present invention for IMT-2000.

FIG. 12 is a diagram illustrating an exemplary application of the present invention for IMT-2000. In IMT-2000, the base station controls the cell on the basis of 6 sectors. Therefore, an antenna system must be installed in each sector. As can be shown, if the sector #1 is a high capacity zone, the antenna system 100 controls the beam with 10 degrees of VBDT, −15 degrees of HBDS, and 32 degrees of HBWS. On the other hand, if the sector #3 has a low capacity zone, the antenna system 100 controls the beam with 5 degrees of VBDT, 0 degree of HBDS and 64 degrees of HBWS, whereby the present invention can control the beam based on the communication environment.

In comparison with the prior art antenna system, the present invention can implement a 3-way beam control. The 3-way beam control can implement simultaneously a vertical beam electrical down tilt, a horizontal beam steering and a horizontal beam width switching. The present invention implement the vertical beam electrical down tilt and the horizontal beam steering on the basis of column or row. This is achieved by utilizing a number multi-line phase shifters. The present invention also the horizontal beam width switching on the basis of row by utilizing a number of switchable dividers. The present invention can control cell coverage more flexible than any other prior arts by utilizing the 3-way beam control. Therefore, the antenna system becomes friendly with user and the communication environment.

As for the horizontal beam width switching, it should also be noted that the present invention is not limited to use of the switchable dividers in a different operating mode provided that the operating signals from the switchable dividers are transmitted to the corresponding radiators of the antenna array with maintaining an equal space each other.

The present invention may implement a vertical beam width switching by replacing the C/Ds with switchable C/Ds.

Further, the present invention can enhance performance and reduce cost by using a multi-line phase shifter.

While the present invention has been described with respect to the particular embodiments, it will be apparent to those skilled in the art that various changes and modifications may be made without departing from the scope of the invention as defined in the following claims.

What is claimed is:

1. An antenna system for use in a wireless communication system, comprising:

an array of M×N radiating elements for emitting a beam, M and N each being a positive integer, respectively;

a feeding network for providing a plurality of signals to the array of M×N radiating elements;

M first phase shifters for steering the beam on the basis of column by phase shifting the plurality of signals from the feeding network; and N second phase shifters for steering the beam on the basis of row by phase shifting the plurality of signals from the feeding network, wherein the feeding network includes:

an input port for receiving the plurality of signals;

N dividers for transmitting the plurality of signals to each of transmission lines of the second phase shifters; and M combiner/dividers for transmitting the plurality of signals to each of transmission lines of the first phase shifters after passing through the second phase shifters.

2. The antenna system of claim 1, wherein each of the first phase shifters simultaneously phase shifts a first group of N signals selected from the plurality of signals by rotating a dielectric member incorporated into each of the first phase shifters.

3. The antenna system of claim 2, further comprising:

a first rotation apparatus that rotates the dielectric members of the first phase shifters.

4. The antenna system of claim 2, wherein each of the first phase shifters includes:

a dielectric member provided with a first and a second portion, wherein a dielectric constant of the first portion is different from a dielectric constant of the second portion; and N transmission lines positioned opposite the dielectric member for transmitting the N signals of the first group, wherein each signal is input to one end of a corresponding transmission line and output to a corresponding radiating element after passing through the corresponding transmission line.

5. The antenna system of claim 1, wherein the M and N represent the number of columns and the number of rows, respectively.

6. The antenna system of claim 4, wherein each of the first phase shifters further includes a metal plate provided with a first and a second part on which the transmission lines are formed.

7. The antenna system of claim 6, wherein N/2 transmission lines are formed on the first part and N/2 transmission lines are formed on the second part.

8. The antenna system of claim 7, wherein the transmission lines of the first part is arranged in such a way that they are symmetric with respect to those of the second part, whereby if electrical lengths of the transmission lines of the first part are increased to a predetermined value, those of the second part are decreased to the predetermined value.

9. The antenna system of claim 3, wherein if the first rotation apparatus rotates the dielectric member of the first phase shifter, signals have a symmetry in phase plane with respect to a center point after passing through the first phase shifter.

10. The antenna system of claim 6, wherein each of the combiner/dividers includes:

a combiner provided with N input ports and an output port; and a divider provided with an input port and N output ports.

11. The antenna system of claim 1, wherein each of the second phase shifters simultaneously phase shifts M signals by rotating a dielectric member incorporated into each of the second phase shifters, the dielectric member being provided with a first and a second portions and a dielectric constant of the first portion being different from a dielectric constant of the second portion.

12. The antenna system of claim 11, further comprising:

a second rotation apparatus that rotates the dielectric members of the second phase shifters.

13. The antenna system of claim 12, wherein each of the second phase shifters includes:

M transmission lines positioned opposite the dielectric member for transmitting the M signals, wherein each of the M signals is input into one end of a corresponding transmission line.

14. The antenna system of claim 13, wherein the second phase shifter further includes a metal plate provided with a first and a second parts on which the transmission lines are formed.

15. The antenna system of claim 14, wherein M/2 transmission lines are formed on the first part and M/2 transmission lines are formed on the second part.

16. The antenna system of claim 15, wherein the transmission lines of the first part is arranged in such a way that they are symmetric with respect to those of the second part, whereby if electrical lengths of the transmission lines of the first part are increased to a predetermined value, those of the second part are decreased to the predetermined value.

17. The antenna system of claim 1, wherein the dividers employ:

N switchable dividers for selectively transmitting the plurality of signals to each of the transmission lines of the second phase shifters.

18. The antenna system of claim 17, wherein each of the switchable dividers includes:

an input port for receiving an input signal;

a common node;

M first transmission lines;

M second transmission lines;

M isolation elements disposed between the first and the second transmission lines, wherein each isolation element is electrically connected to corresponding first and second transmission lines, respectively;

M output ports for outputting M output signals, each of the output ports being connected to a portion between a corresponding isolation element and a corresponding first or second transmission line;

a first switch for selectively switching the input signal to the first transmission lines; and a second switch for selectively switching the common node to the second transmission lines based on the first switch.

19. The antenna system of claim 18, wherein M is 4 and N is 8 for applying to INT-2000.

20. The antenna system of claim 17, further comprising:

a beam control board for generating control signals to control the switchable dividers, the first phase shifters and the second phase shifters.

21. The antenna system of claim 1, wherein N is 1 and the second phase shifter steers the beam by simultaneously phase shifting the plurality of signals from the feeding network.

22. The antenna system of claim 21, wherein each of the first phase shifters includes:

a dielectric member provided with a first portion and a second portion, wherein a dielectric constant of the first portion is different from a dielectric constant of the second portion; and N transmission lines positioned opposite the dielectric member for transmitting N signals selected from the plurality of signals, wherein each of the N signals is inputted to one end of a corresponding transmission line and outputted to a corresponding radiating element.

23. The antenna system of claim 22, further comprising:

a rotation apparatus that rotates the dielectric member of each of said first phase shifters.

24. An antenna system for use in a wireless communication system, comprising:

an array of M×N radiating elements for emitting a beam, M and N being positive integers, respectively;

a switchable divider for selectively providing a plurality of signals to the array of M×N radiating elements;

a phase shifter for steering the beam on the basis of row by simultaneously phase shifting the plurality of signals from the switchable divider;

M providers for providing the plurality of signals to the array of M×N radiating elements; and M phase shifters for steering the beam on the basis of column by phase shifting the plurality of signals from the M providers.

25. The antenna system of claim 24, wherein the switchable divider includes:

an input port for receiving an input signal;

a common node;

M first transmission lines;

M second transmission lines;

M isolation elements disposed between the first and the second transmission lines, wherein each isolation element is electrically connected to corresponding first and second transmission lines, respectively;

M output ports for outputting M output signals, each of the output ports being connected to a portion between a corresponding isolation element and a corresponding first or second transmission line;

a first switch for selectively switching the input signal to the first transmission lines; and a second switch for selectively switching the common node to the second transmission lines based on the first switch.

26. The antenna system of claim 25, wherein a horizontal width of the beam is controlled by changing M of the switchable divider.

27. An antenna system for use in a wireless communication system, comprising:

an array of M×N radiating elements for emitting a beam, M and N each being a positive integer, respectively;

a feeding network for providing a plurality of signals to the array of M×N radiating elements;

M first phase shifters for steering the beam on the basis of column by phase shifting the plurality of signals from the feeding network, wherein each of the first phase shifters simultaneously phase shifts a first group of N signals selected from the plurality of signals by rotating a dielectric member incorporated into each of the first phase shifters;

N second phase shifters for steering the beam on the basis of row by phase shifting the plurality of signals from the feeding network; and a first rotation apparatus that rotates the dielectric members of the first phase shifters, wherein when the first rotation apparatus rotates the dielectric member of the first phase shifter, signals have a symmetry in a phase plane with respect to a center point after passing through the first phase shifter.

28. The antenna system of claim 27, wherein each of the first phase shifters comprises:

a dielectric member provided with a first and a second portion, wherein a dielectric constant of the first portion is different from that of the second portion; and N transmission lines positioned opposite the dielectric member for transmitting the N signals of the first group, wherein each signal is input to one end of a corresponding transmission line and output to a corresponding radiating element after passing through the corresponding transmission line.

29. The antenna system of claim 28, wherein each of the first phase shifters further includes a metal plate provided with a first and a second part on which the transmission lines are formed.

30. The antenna system of claim 29, wherein N/2 transmission lines are formed on the first part and N/2 number of transmission lines are formed on the second part.

31. The antenna system of claim 30, wherein the transmission lines of the first part are arranged such that they are symmetric with respect to the transmission lines of the second part, whereby if electrical lengths of the transmission lines of the first part are increased to a predetermined value, the transmission lines of the second part are decreased to the predetermined value.

* * * * *